US007128127B1

(12) United States Patent
Love et al.

(10) Patent No.: US 7,128,127 B1
(45) Date of Patent: Oct. 31, 2006

(54) FABRIC DISPLAY WITH REVERSE BEND FABRIC ARM

(76) Inventors: Steven Reed Love, 70859 Jasmine La., Rancho Mirage, CA (US) 92270; Jian Lou, 8411 Fairview Ct., Lonetree, CO (US) 80124

( * ) Notice: Subject to any disclaimer, the term of this patent is extended or adjusted under 35 U.S.C. 154(b) by 97 days.

(21) Appl. No.: 10/600,265

(22) Filed: Jun. 20, 2003

Related U.S. Application Data

(60) Provisional application No. 60/390,290, filed on Jun. 21, 2002.

(51) Int. Cl.
*A47H 1/00* (2006.01)

(52) U.S. Cl. ..... 160/335; 40/607.01; 40/611.06

(58) Field of Classification Search ..... 40/607.01, 40/611.06, 492, 611.01, 606.15, 617; 116/173; 160/10, 330, 335, 336, 125, 387; 248/317, 248/341; 434/75; 211/55, 180, 96; 223/85, 223/95, 97

See application file for complete search history.

(56) References Cited

U.S. PATENT DOCUMENTS 1,681,595 A * 8/1928 Ray ..... 248/229.1
2,052,771 A * 9/1936 Johnson ..... 40/617
3,088,235 A * 5/1963 Kies ..... 40/477
4,063,648 A * 12/1977 Fuller et al. ..... 211/45
4,237,636 A 12/1980 Matthews
D306,179 S 2/1990 Friedman
D311,858 S 11/1990 Richmond
D317,992 S 7/1991 Miller
5,347,738 A 9/1994 Zweig et al.
5,694,733 A * 12/1997 Gallemore, II ..... 52/736.2
6,015,122 A * 1/2000 Qui ..... 248/156
RE36,873 E * 9/2000 Gouldson et al. ..... 223/91
2001/0015361 A1* 8/2001 Gouldson ..... 223/85

* cited by examiner

*Primary Examiner*—Joanne Silbermann
(74) *Attorney, Agent, or Firm*—Merchant & Gould P.C.

(57) ABSTRACT

A fabric display includes a fabric arm having a main segment that extends forward and terminates in a reverse bend segment at a front end of the fabric arm. A bend arm extends rearward from the reverse bend segment and is adapted to support a leading "salvage" edge of a fabric sheet that is displayed on the fabric arm so that a relatively clean "roll" edge of the fabric is presented to viewers at a front end of the fabric arm adjacent the reverse bend segment. Opposing fabric arms may be attached to a pivotable support arm to allow viewers to easily observe two separate fabric sheets supported on the opposing fabric arms.

10 Claims, 5 Drawing Sheets

FABRIC DISPLAY WITH REVERSE BEND FABRIC ARM

RELATED APPLICATIONS

This application claims priority of U.S. provisional application Ser. No. 60/390,290, entitled "Fabric Display With Reverse Bend Fabric Arm," filed Jun. 21, 2002.

FIELD OF THE INVENTION

This application relates generally to fabric displays and more particularly to a fabric display with a fabric arm having a reverse bend to present a clean roll edge of a front side of the fabric.

BACKGROUND OF THE INVENTION

Fabric displays are used to display fabric sheets so that viewers can observe the sheets prior to purchasing a length of the fabric sheet. A typical fabric display includes a horizontal fabric arm for displaying a single fabric sheet such as by draping the sheet over the fabric arm or forming a sleeve at one end of the sheet and sliding the sheet over the horizontal arm so that the fabric sheet hangs from the arm. Typically, it is desirable to display a "front" side of the fabric on both sides of the fabric arm since the rear surface of the fabric may not have a pleasing appearance. While this effect may be achieved by draping the fabric sheet over the horizontal arm, a salvage edge of the fabric typically remains exposed to the viewer and this edge can again provide an aesthetically poor appearance. In addition to displaying a rough cut salvage edge, draped fabric sheets often are misaligned on the horizontal fabric arm so that viewers will again be able to see the rear surface of the fabric sheet as they peruse the different offerings on a large fabric display.

To overcome the undesirable appearance of conventional fabric displays (using conventional horizontal arms to hold the fabric sheets), fabric display users often attempt to fold the exposed salvage edge of the fabric back to produce a cleaner appearance (i.e., a "roll edge" displaying the front surface of the fabric). However, maintaining the fabric in the rolled orientation so as to continually display the relatively clean roll edge has proven extremely difficult, particularly since shoppers will repeatedly handle the fabric sheet on the horizontal display arm.

A further problem with conventional fabric displays is that they are typically large structures that are intended to be permanently mounted within a store or showroom. Such displays are cumbersome to transport and assemble and are not amenable for use as a portable display for use in venues such as tradeshows, craft shows or other temporary stores.

Thus, an improved fabric display is needed that will improve the aesthetic appeal of displayed fabric sheets by displaying a clean roll edge of the sheet in a relatively secure manner that will withstand handling of the sheet by potential customers. The improved fabric display should also be less cumbersome than prior art displays and provide users with the ability to easily assemble and disassemble the display to support temporary or portable displays. It is with respect to these and other background considerations, limitations and problems that the present invention has evolved.

SUMMARY OF THE INVENTION

The above and other problems are solved by a fabric display that utilizes a support arm with at least one and preferably opposing fabric arms attached to each side of the support arm. In one preferred embodiment, each fabric arm is connected at a rear end to the support arm and includes a main segment that extends forward along side the support arm. The main segment terminates in a reverse bend segment at a front end of the fabric arm, and a bend arm extends rearward from the reverse bend segment between the main segment of the fabric arm and the support arm. The inclusion of the reverse bend segment and the bend arm allows a fabric sheet to be supported on the fabric arm so that a leading "salvage" edge of the fabric may be manipulated around the bend segment and ultimately supported on the bend arm, thereby providing a relatively clean "roll" edge of the fabric to be presented to viewers at the front end of the fabric arm.

In accordance with one embodiment of the present invention, the bend arm is selectively attached to the support arm so that the front end of the fabric arm can be detached from the support arm while positioning the fabric sheet on the fabric arm. Once the fabric sheet is properly arranged on the fabric arm, the bend arm is reattached to the support arm to help support the weight of the fabric sheet and to prevent the fabric sheet from shifting on the fabric arm. In another embodiment, the support arm is pivotably connected to a support surface to allow a user to pivot the support arm to view fabric sheets supported on opposite sides of the arm.

In another embodiment of the present invention, a method of displaying a fabric sheet utilizes a fabric arm having a main segment extending forward to a front end of the fabric arm, a reverse bend at the front end of the fabric arm, and a bend arm extending rearwardly from the reverse bend. The method includes the steps of supporting the fabric sheet on the fabric arm so that a leading edge of the fabric sheet is positioned between the main segment and the bend arm of the fabric arm, and then sliding the leading edge of the fabric sheet forward along main segment of the fabric arm to the reverse bend. The leading edge of the fabric sheet is then manipulated rearward from the reverse bend along the bend arm so that a roll edge of the fabric sheet is displayed at the front end of the fabric arm. In one embodiment, the fabric sheet includes a top loop for supporting the sheet on the fabric arm, although it is also possible to simply drape the fabric sheet over the substantially horizontal fabric arm. The method also preferably includes the steps of selectively detaching the bend arm from a support arm prior to sliding the fabric sheet along the fabric arm and then selectively reattaching the bend arm to the support arm to help support the weight of the fabric sheet and hold the sheet in place on the fabric arm.

The present invention provides vast improvements in the aesthetic appeal of the displayed fabric sheets by utilizing a fabric arm having a reverse bend segment so that the leading "salvage" edge of the sheet is hidden out of view while a relatively clean and attractive "roll" edge is displayed at the front end of the fabric arm. These and various other features as well as advantages, which characterize the present invention, will be apparent from a reading of the following detailed description and a review of the associated drawings.

BRIEF DESCRIPTION OF THE DRAWINGS

FIG. 7 is a perspective view similar to FIGS. 5 and 6, showing the fabric sheet positioned around both the bend segment and the bend arm of the fabric arm, wherein FIGS. 5–7 illustrate a sequence of loading a fabric sheet onto the fabric arm so that a clean roll edge of the fabric sheet is presented at the front end of the fabric arm.

DETAILED DESCRIPTION

Figure 1:
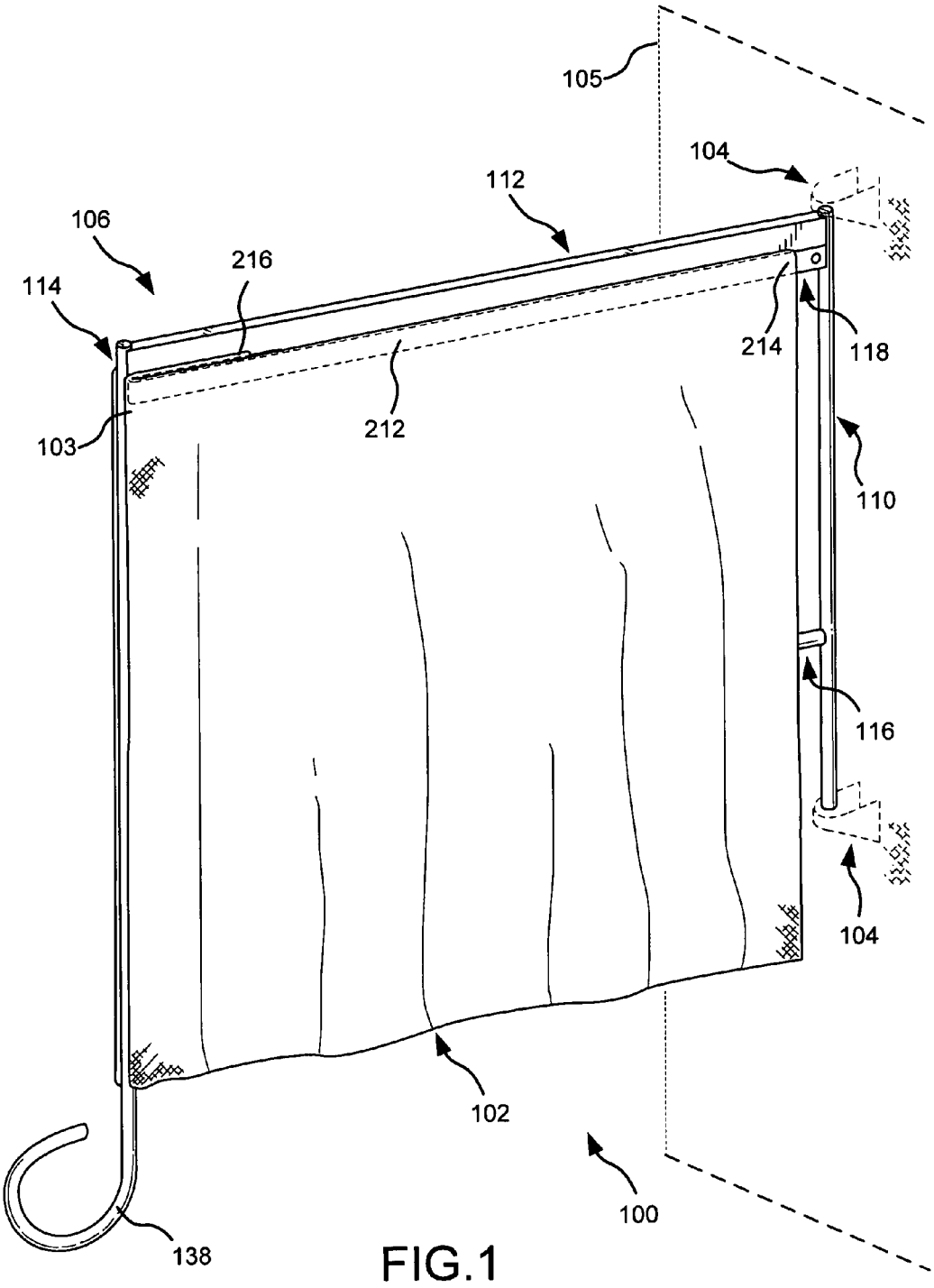
FIG. 1 is a perspective view of a fabric display in accordance with a preferred embodiment of the present invention illustrating fabric sheets attached to opposite sides of the display.
Figure 2:
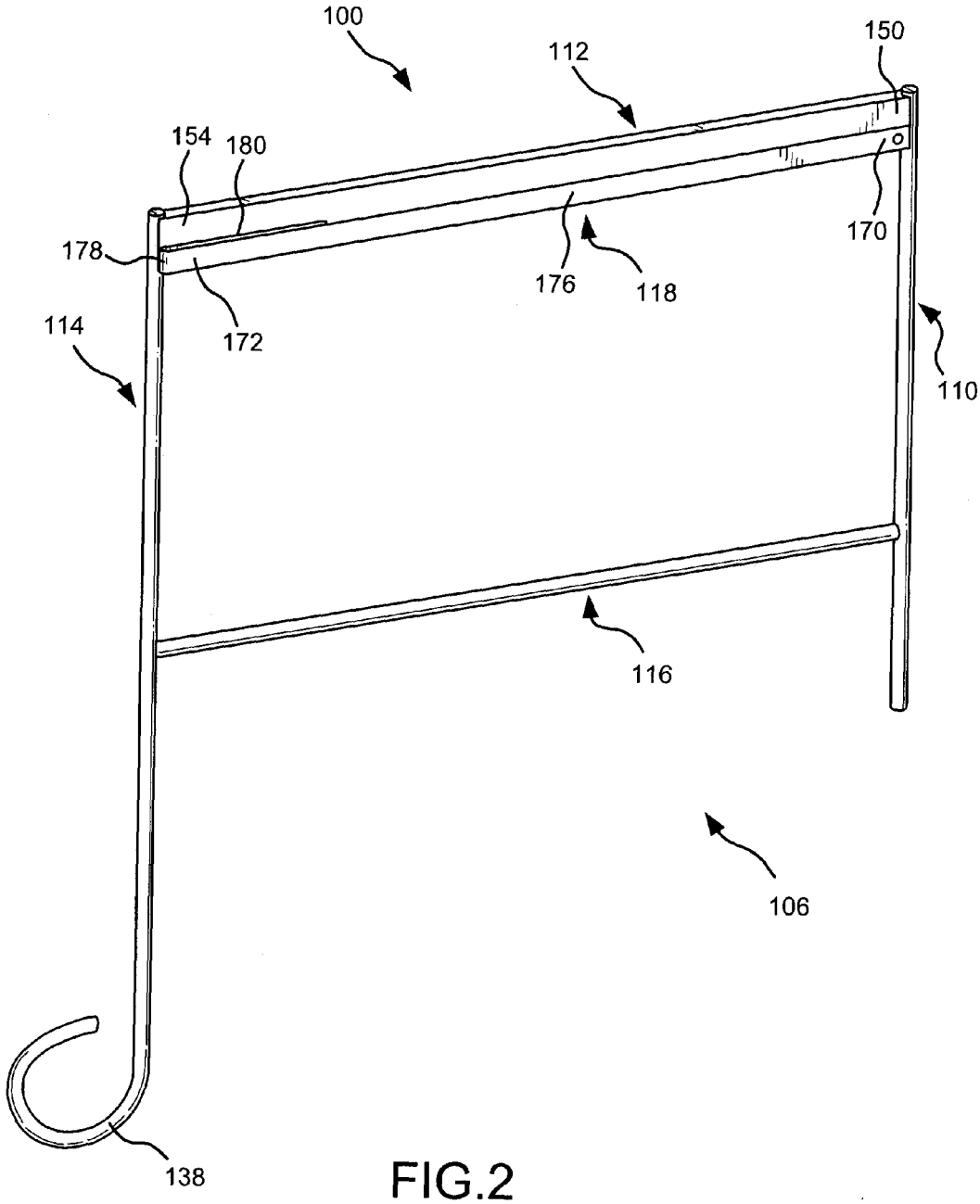
FIG. 2 is a perspective view of the fabric display of FIG. 1 shown without the attached fabric sheets.
Figure 3:
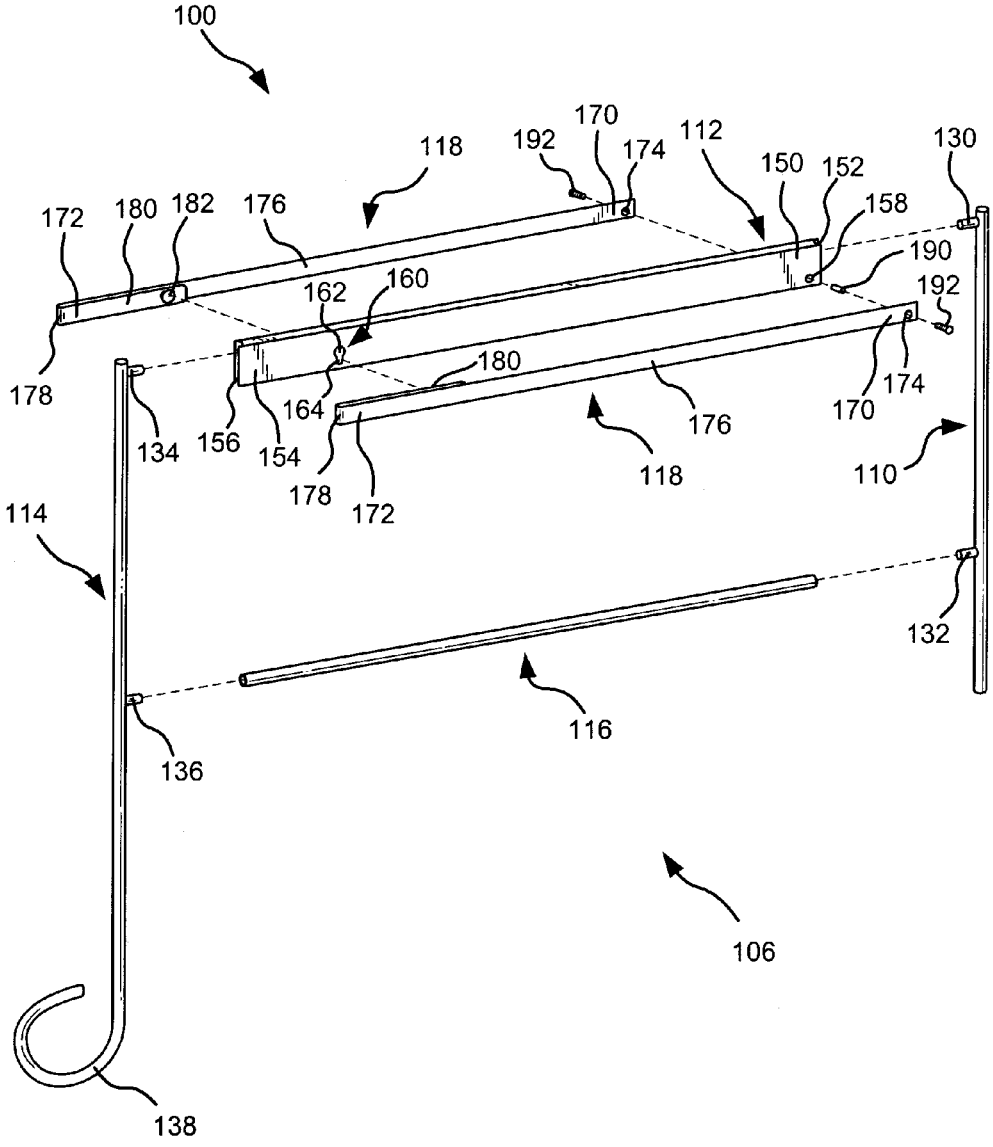
FIG. 3 is an exploded perspective view of the fabric display of FIGS. 1 and 2.

A fabric display 100 according to an embodiment of the present invention is illustrated in FIGS. 1–3. The fabric display 100 supports a fabric sheet 102 so that viewers can easily observe the fabric sheet 102, such as in a fabric store environment. The fabric display 100 is mounted to a wall along a trailing edge of the sheet 102 so that a leading edge of the sheet protrudes outward toward viewers who may manipulate the display 100 to view different ones of the fabric sheets 102 stored thereon. The present invention beneficially supports each fabric sheet 102 so that the leading edge is folded back behind the main body of the sheet 102 creating an aesthetically pleasing roll edge 103 that faces the viewer as shown in FIG. 1, thereby giving each sheet 102 on the fabric display 100 a desirable appearance.

In one preferred embodiment, the fabric display 100 includes a frame 106 that is pivotably mounted to a wall or other support surface 105 through the use of opposing brackets 104. More specifically, the frame 106 includes a vertical pivot rod 110 that is secured between the brackets 104 so that the rod 110 is able to pivot about a vertical axis passing through the rod 110 and the opposing brackets 104. While the frame 106 shown in FIG. 1 is preferably mounted to a wall, the present invention encompasses the use of alternative support means (such as a weighted base) for the rod 110 to provide for a more portable version of the display 100 as described below.

As best shown in FIGS. 2 and 3, the frame 106 includes a support arm 112 that extends forward from the top of the pivot rod 110, and a handle rod 114 that depends from a front end of the support arm 112. Fabric arms 118 extend along opposite sides of the support arm 112, so that each fabric arm 118 can display a different fabric sheet 102 on either side of the support arm 112. A cross brace 116 preferably extends between a lower portion of the pivot rod 110 and the handle rod 114 to help prevent the support arm 112 from bending under the weight of the fabric sheets 102.

Referring now to FIG. 3, the main parts of the frame 106 preferably snap together to facilitate easy assembly and disassembly of the fabric display 100. Specifically, the pivot rod 110 preferably comprises a cylindrical rod, which may be formed as either a solid or a hollow rod (i.e., a solid rod 110 may be preferred for a more permanent installation of the display 100 while a hollow tube may be preferred for a more portable version of the display). The pivot rod 110 includes a forward-facing top fitting pin 130 and a forward-facing bottom fitting pin 132. Likewise, the handle rod 114 is preferably a cylindrical rod (either hollow or solid) that includes a rearward-facing top fitting pin 134 and a rearward-facing bottom fitting pin 136. Additionally, a lower portion of the handle rod 114 is preferably curved to form a display handle 138. Alternatively, a separate handle 138 may be fixed to a bottom portion of handle rod 114. Further still, the handle 138 may be fixed to a top end of the handle rod 114, such as for displays 100 that are fixed at a low height relative to a viewer.

The support arm 112 is preferably a hollow bar formed from a metal such as aluminum, although the arm 112 may be formed from a solid metal bar or may be formed from a reinforced plastic material instead of metal. The support arm 112 includes a rear end 150 that preferably defines a vertically-extending semi-cylindrical rear recess 152 that receives a curved surface of the pivot rod 110. Additionally, the semi-cylindrical rear recess 152 defines a hole (not shown) extending forward through the support arm 112 that receives the top fitting pin 130 of the pivot rod 110. Likewise, the support arm 112 includes a front end 154 that defines a vertically extending semi-cylindrical front recess 156 that receives a curved surface of the handle rod 114. The front end 154 similarly defines a rearwardly extending hole (not shown) that receives the top fitting pin 134 of the handle rod 114. In like manner, the rearward and forward ends of the cross brace 116 define holes that receive the bottom fitting pin 132 of the pivot rod 110 and the bottom fitting pin 136 of the handle rod 114, respectively. The cross brace 116 thus provides support for the frame 106 and helps to prevent bending of the support arm 112 when relatively heavy fabric sheets 102 are held by the display 100.

The support arm 112 further defines a rear fastener hole 158 (FIG. 3) that extends horizontally through the rear end 150 of the arm 112. The front end 154 of the support arm 112 preferably defines snap apertures 160 that extend into opposing sides of the support arm 112, where each aperture 160 each include a circular hole 162 that opens into a downwardly-extending slot 164.

Figure 4:
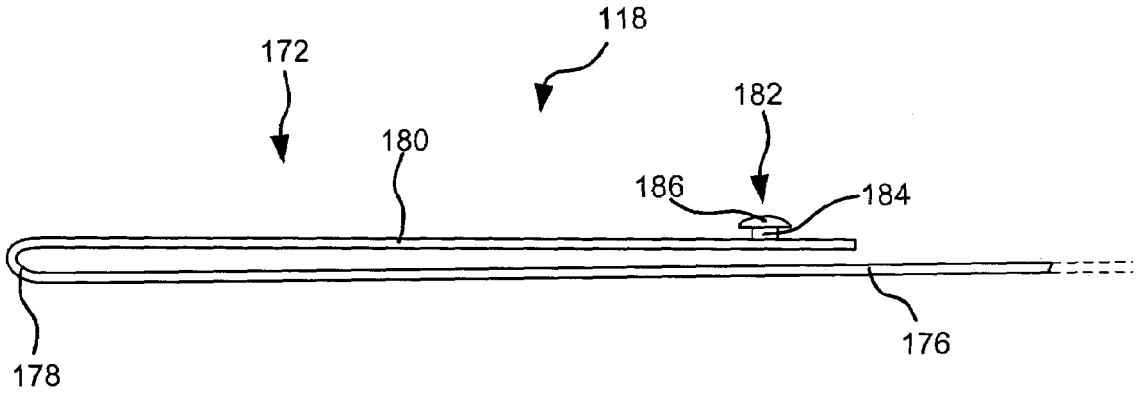
FIG. 4 is an enlarged top plan view of a forward portion of a fabric arm used with the fabric display of FIG. 1 illustrating a main segment, and reverse bend and a rearward extending bend arm of the fabric arm.

Referring to FIGS. 3–4, the fabric arms 118 attached to each side of the support arm 112 each define a rear end 170 attached to the rear end 150 of the support arm 112 via a fastener hole 174 (FIG. 3) that is aligned with the rear fastener hole 158 of the support arm 112. In one embodiment, the connection of the rear end 170 of each fabric arm 118 to the support arm 112 is facilitated by the use of a tubular fitting 190 (FIG. 3) seated within the fastener hole 158 formed in the support arm 112. The tubular fitting 190 preferably includes engaging elements such as female threads for receiving fasteners 192. Each fastener 192 extends through a corresponding fastener hole 174 in the fabric arms 118 and into opposite sides of the fitting 190 to securely attach the rear ends 170 of the fabric arms 118 to opposite sides of the rear end 150 of the support arm 112. The use of the tubular fitting 190 simplifies the manufacturing and assembly process, although other means for securing the rear ends 170 of the fabric arms 118 to the support arm 112 may be utilized. For example, the fastener hole 158 could itself be threaded to directly receive the threaded fasteners 192. Alternatively, a bolt and washer construction could be used so that the head of the bolt contacts the rear end 170 of one of the fabric arms 118, while the washer engages the rear end 170 of the fabric arm 118 on the opposite side of the support arm 112.

A main segment 176 of each fabric arm 118 extends forward from the rear end 170 to a generally U-shaped reverse bend segment 178 that bends inward toward the support arm 112. The fabric arm 118 continues to extend rearward from the U-shaped reverse bend segment 178 to define a bend arm 180 that extends rearward between a portion of the main segment 176 and the support arm 112 so that the bend arm 180 is spaced laterally from the support arm 112 as shown in FIG. 4. The length of the bend arm 180 is substantially less than the length of the main segment 176 and is preferably approximately 20–30% of the overall length of the main segment 176. While the rear end 170 of each fabric arm 118 is preferably fixed to the support arm 112 as described above, a front end 172 of each arm 118 is selectively attached to the front end 154 of the support arm 112 adjacent the front end 154. The selective attachment allows the front end 172 of the arm 118 to be detached from the support arm 112 so that a fabric sheet 102 may be loaded on the arm 118 as described below.

In a presently preferred embodiment, a snap knob 182 (FIG. 4) is attached to each bend arm 180 and includes a cylindrical neck 184 that extends outwardly from the bend arm 180 and terminates in a head 186 that extends radially outwardly from the neck 184. Each neck 184 is preferably sized to slide within the associated slot 164 of the support arm snap aperture 160, while each head 186 is preferably sized to fit within the circular hole 162 of the support arm snap aperture 160 (but not within the associated slot 164). Most preferably, the head 186 is sized to form a slight interference fit with the circular hole 162 so that the head 186 can be snapped into and out of the circular hole 162. In this manner, the front end 172 of each arm 118 may be selectively snapped out of the snap aperture 160 and extended away from the support arm 112 to facilitate loading a fabric sheet 102 on the fabric arm 118, as described below. Similarly, the front end 172 of each fabric arm 118 can be selectively attached to the support arm 112 once a fabric sheet 102 has been loaded onto the fabric arm 118 by snapping the head 186 of the knob 182 into the circular hole 162 and sliding the neck 184 of the knob 182 downwardly along the associated slot 164. In the resulting attached position, the front end 172 of the fabric arm 118 is supported by the support arm 112.

Referring to FIGS. 1 and 5–7, the display fabric sheet 102 is preferably folded to form a sleeve 212 extending along its top edge from a rear end 214 to a front end or leading edge 216 of the sheet 102. Once the fabric sheet 102 is loaded on the fabric arm 118 as described below, the sheet 102 will form a forward-facing roll edge or fold 103 that gives the fabric sheet 102, and indeed the entire fabric display 100, an orderly and aesthetically pleasing appearance. The fabric may be any type of pliable fabric that a user desires to display. The use of the fabric display 100 to hold different fabric sheets 102 will now be described.

Figure 5:
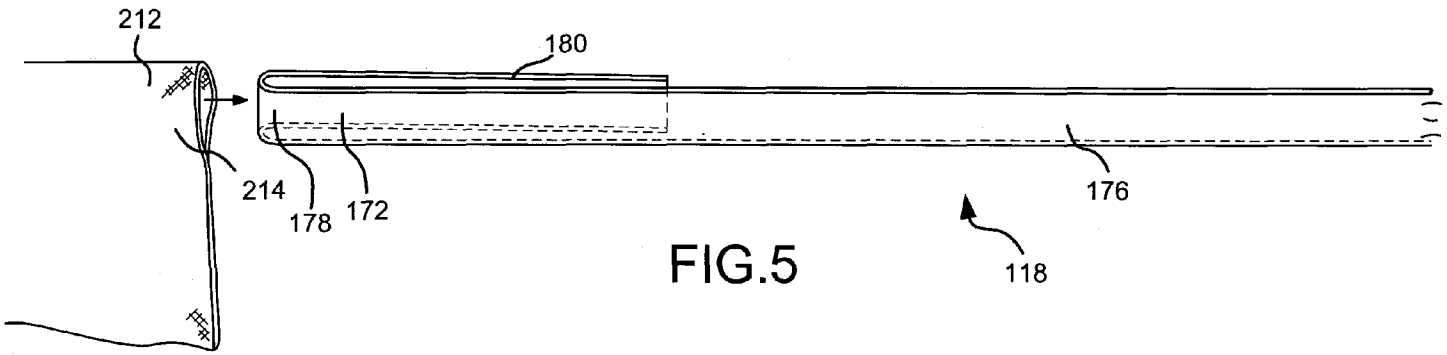
FIG. 5 is a side perspective view of the forward portion of the fabric arm of FIG. 4, illustrating a fabric sheet that is to be loaded onto the fabric arm.
Figure 6:
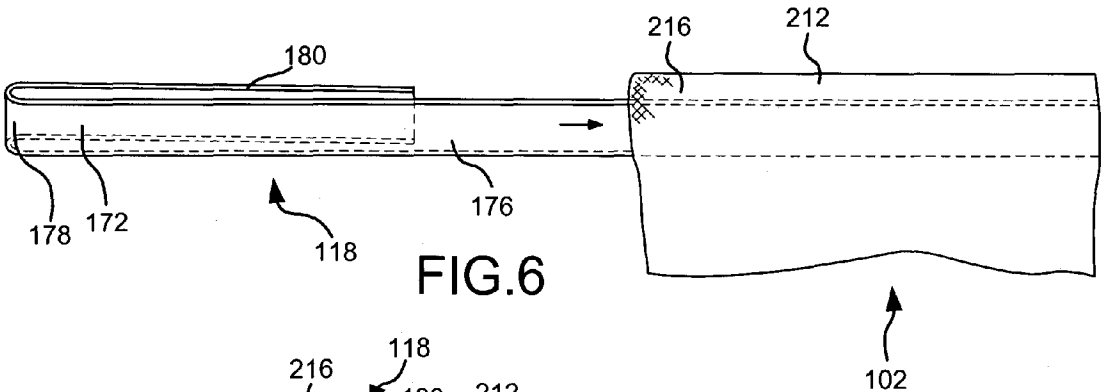
FIG. 6 is a perspective view similar to FIG. 5, showing the fabric sheet on the main segment of the fabric arm and positioned to the rear of the bend arm.
Figure 7:
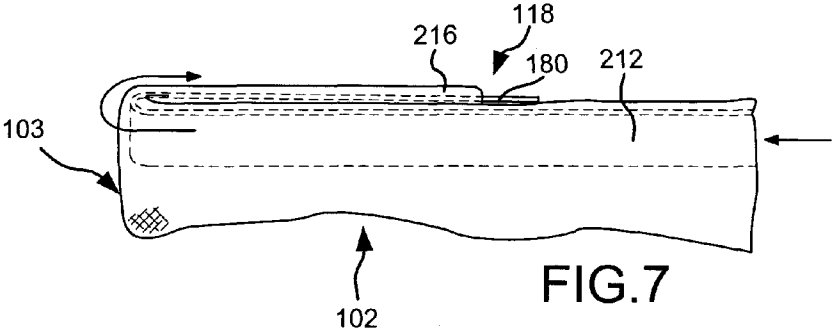

To position a display fabric sheet 102 on the fabric display, a user releases or disconnects the front end 172 of a fabric arm 118 from the support arm 112 as described above. Then, as shown in FIG. 5, the user slides the rear end 214 of the sleeve 212 of the fabric sheet 102 over the reverse bend segment 178 and over the bend arm 180 of the fabric arm 118. As shown in FIG. 6, the user continues to slide the sleeve 212 of the fabric sheet 102 rearward over the main segment 176 of the fabric arm 118 until the front end 216 slides past the end of the bend arm 180. The user then preferably slides the front end 216 of the sleeve 212 forward along the main segment 176, but to the side of the bend arm 180 (as shown in FIG. 7) until the front end 216 reaches the reverse bend segment 178. The user then slides the front end 216 around the reverse bend segment 178 and continues sliding it rearward along the bend arm 180 until the front edge 216 substantially reaches the snap knob 182 (FIG. 4) attached to the end of the bend arm 180. By folding the front edge of the fabric sheet 102 around the bend segment 178 in this manner, the "salvage" front edge of the fabric sheet 102 is hidden from view and the rounded, forward-facing roll edge or fold 103 (FIGS. 1 and 7) extends outward adjacent the handle rod 114 to provide a more orderly and attractive appearance for viewers wishing to inspect the fabric sheet 102. Once the fabric sheet 102 is positioned on the fabric arm 118 as shown in FIG. 7, the user then re-connects the front end 172 of the fabric arm 118 to the support arm 112 via the snap knob 182 as described above. This process is preferably repeated to place a fabric sheet 102 on the second fabric arm 118 on the opposite side of the support arm 112.

In removing a display fabric sheet 102 from the fabric display 100, the above-described mounting process is reversed. More specifically, a user disconnects the front end 172 of the associated fabric arm 118 from the end of the support arm 112. The user then slides the front end 216 of the sleeve 212 forward along the bend arm 180, around the reverse bend 178, and rearward along the main segment 176 until the front end 216 is past the end of the bend arm 180. The user then slides the front end 216 of the sleeve 212 forward over the bend arm 180 until the front end 216 slides over the reverse bend 178 and off the fabric arm 118. The user continues to slide the sleeve 212 forward until the rear end 214 of the sleeve 212 likewise slides past the reverse bend 178 and off the fabric arm 118.

In using the fabric display 100, one need only grasp the handle 138 and pivot the frame 106 about the axis of the pivot rod 110 to obtain a view of both fabric sheets 102 on either side of the support arm 112. Furthermore, due to the inclusion of the reverse bend 178 and the bend arm 180 on each of the fabric arms 118, the present invention ensures that a viewer will see only the desired side of the fabric sheet 102 as well as the clean roll edge 103 as the viewer pivots the frame 106 to view both fabric sheets 102.

The display 100 may comprise a plurality of frames 106 whereby the pivot rods are lined up next to one another along a wall or other support surface so that a user may peruse a large number of fabric sheets at one time by pivoting one frame 106 which, in turn, may cause adjacent frames 106 to be pivoted as well. Alternatively, instead of aligning a plurality of the frames 106 in a line along a wall, the frames may be anchored within a standalone display such as a round, weighted base having sockets formed about a circumference of the base to support a bottom end of the pivot rod 110. Such a portable base may include a center post supporting an upper portion for anchoring a top end of the pivot rods 110. Such a standalone base would allow users to walk around the base to obtain a better view of the different fabric sheets 102 while still allowing an individual frame 106 to be pivoted so that the sheets on either side of the frame 106 may be more easily inspected. In this manner, the standalone display could be used as part of a portable display 100 whereby the plurality of racks could be disassembled for transport and then reassembled on the portable base at the final destination. The portable nature of the display 100 is enhanced by the ease of assembly and disassembly of the frame 106 as described above and as shown in FIG. 3.

As noted above, the various components of the frame 106 (i.e., the pivot rod 110, the support arm 112, the handle rod 114, the cross brace 116, and the fabric arms 118) are preferably are all preferably made of metal, such as aluminum or steel. However, one or more of the components could also be formed from a plastic polymer or some other type of structural material that would reduce the overall weight of the device (and thereby enhance its portability). Furthermore, the precise design of the frame may be altered by those skilled in the art without exceeding the scope of the present invention, provided that the fabric arms 118 retain the reverse bend 178 that allows for the orderly display of the roll edge 103 of the fabric sheets 102. For example, the cross brace 116 may extend above the support arm 112 using a typical truss architecture. Further still, the support arm 112 may be adequately strengthened (or the display 100 may be used with lightweight fabrics such as chenille sheets) so that there is no need for a cross brace 116 (or a handle rod 114). In such cases, the support arm 112 would simply extend horizontally from the support surface, while a handle or other means may be attached to the end of the arm 112 to allow a user to pivot the arm 112 and the attached fabric arms 118. Additionally, in those cases where the fabric sheet 102 are relatively light, it may not be necessary to attach the bend arm 180 to the support arm 112 to help support the weight of the fabric. Rather, the fabric arm 118 may be supported in a cantilever fashion from the rear end 170 of the arm 118.

Furthermore, while the reverse bend 178 represents an important feature of the display 100, the precise design of the bend segment 178 and the bend arm 180 may be altered by those skilled in the art without deviating from the scope of the present invention. For example, the bend segment 178 (and the attached bend arm 180) may be squared off rather than curved in order to facilitate manufacture of the fabric arm 118. Additionally, the size of the bend segment 178 (i.e., the distance between the bend arm 180 and the main segment 176 of the fabric arm 118) may be altered to accommodate different fabric types. For example, the curve of the bend segment 178 may be made more gradual to provide sufficient room for the sleeve 212 of a heavy fabric sheet 102 to negotiate the turn around the bend segment 178.

It will be clear that the present invention is well adapted to attain the ends and advantages mentioned as well as those inherent therein. While a presently preferred embodiment has been described for purposes of this disclosure, various changes and modifications may be made which are well within the scope of the present invention. For example, while the bend segment 178 and bends arm 180 are described above for use with fabric sheets 102 employing a sleeve 212 at one end, the present invention may be utilized with fabric sheets 102 having no sleeve 212 but which are rather draped over the fabric arm 118 and then slid forward around the bend segment 178 to provide the same clean roll edge 103. Additionally, while a snap knob 182 is described as providing the connection between the bend arm 118 and the support arm 112, those skilled in the art could substitute a variety of other fasteners in place of the knob 182 and the aperture 160 formed in the support arm 112. Numerous other changes may be made which will readily suggest themselves to those skilled in the art and which are encompassed in the spirit and scope of the invention as defined in the appended claims.

What is claimed is:

1. A fabric display comprising:

a support arm having a first end attached to a support surface and a second end extending substantially horizontally from the support surface; and a fabric arm adapted to support a fabric sheet, the fabric arm comprising:

a main segment having a rear end fixedly attached to the first end of the support arm and a front end that extends forward from the rear end along one side of the support arm;

a reverse bend at the front end of the fabric arm, wherein the reverse bend extends inwardly from the main segment toward the support arm; and a bend arm that extends substantially rearward from the reverse bend between the main segment and the support arm, wherein the bend arm laterally spaces the main segment of the fabric arm from the support arm to provide clearance for loading a portion of the fabric sheet between the main segment of the fabric arm and the support arm so that the fabric sheet is supported on the fabric arm without direct attachment to the support arm, and wherein the bend arm includes a snap knob having a head adapted for releasable connection within an aperture formed in the support arm to provide a releasable connection with the support arm in a manner that does not damage the fabric sheet.

2. A fabric display as defined in claim 1, wherein a length of the bend arm is substantially less than a length of the main segment of the fabric arm.

3. A fabric display as defined in claim 2, wherein the length of the bend arm is approximately 20–30% of the length of the main segment of the fabric arm.

4. A fabric display as defined in claim 1, wherein the support arm is pivotably mounted to the support surface.

5. A fabric display as defined in claim 1, wherein a second fabric arm is attached to an opposite side of the support arm, and wherein each fabric arm is adapted to display a separate fabric sheet.

6. A fabric display comprising:

a pivot arm rotatably mounted to a support surface to pivot about a substantially vertical axis;

a support arm having a first end attached to the pivot arm and a second end extending substantially horizontally from the pivot arm;

a handle arm attached to the second end of the support arm, the handle arm extending substantially parallel to the pivot arm;

a fabric arm adapted to support a fabric sheet, the fabric arm comprising:

a main segment having a rear end fixedly attached to the first end of the support arm and a front end that extends forward from the rear end along one side of the support arm;

a reverse bend at the front end of the fabric arm, wherein the reverse bend extends inwardly from the main segment toward the support arm;

a bend arm that extends substantially rearward from the reverse bend between the main segment and the support arm, wherein the bend arm is not fixedly attached to the support arm, and wherein the bend arm laterally spaces the main segment of the fabric arm from the support arm to provide clearance for loading a portion of the fabric sheet between the main segment of the fabric arm and the support arm to allow the fabric arm to support the fabric sheet without direct attachment of the fabric sheet to the support arm; and further comprising a cross brace attached to both the pivot arm and the handle arm to help support a load applied to the fabric arm.

7. A fabric display as defined in claim 6, wherein the cross brace extends substantially parallel to the support arm.

8. A fabric display as defined in claim 6, wherein the pivot arm is mounted for rotation between opposing brackets attached to the support surface.

9. A fabric display as defined in claim 6, further comprising a handle attached to one end of the handle arm.

10. A fabric display as defined in claim 9, wherein the handle is formed integrally with the handle arm.

* * * * *